United States Patent [19]

Hur

[11] Patent Number: 4,985,935

[45] Date of Patent: Jan. 22, 1991

[54] CAP VISOR CONTAINING DISPLAY MEANS

[76] Inventor: Kyoung M. Hur, 1234 Lexington Ave., New York, N.Y. 10028

[21] Appl. No.: 467,373

[22] Filed: Jan. 19, 1990

Related U.S. Application Data

[63] Continuation-in-part of Ser. No. 286,085, Dec. 19, 1988.

[51] Int. Cl.[5] ..... A42B 1/00

[52] U.S. Cl. ..... 2/209.1; 2/10; 2/199; D2/248

[58] Field of Search ..... 2/185 R, 186, 195, 196, 2/199, 209.1; 446/26, 27, 148; D2/244, 248

[56] References Cited

U.S. PATENT DOCUMENTS

| | | | |
|---|---|---|---|
| D. 258,323 | 2/1981 | Lewis | D2/248 |
| D. 284,328 | 6/1986 | Bieber | D2/250 |
| 911,126 | 2/1909 | Harrison et al. | D2/244 |
| 2,475,471 | 7/1949 | Brown et al. | D2/246 |
| 2,648,847 | 8/1953 | Crowder | 2/199 |
| 2,735,109 | 2/1956 | Feldman | 2/195 |
| 3,228,139 | 1/1966 | Lohnes | 446/148 |
| 4,321,708 | 3/1982 | Troiano | 2/199 |
| 4,793,006 | 12/1988 | Dawson | 2/191 |

OTHER PUBLICATIONS

Maurice Gershman M. D.; "Self-Adhering Nylon Tapes"; Journal of A.M.A.; vol. 168, No. 7; 10/19/58.

*Primary Examiner*—Werner H. Schroeder
*Assistant Examiner*—Diana L. Biefeld
*Attorney, Agent, or Firm*—Birch, Stewart, Kolasch & Birch

[57] ABSTRACT

A cap visor having display means which includes a lower visor, a foldable upper visor being connected to each other in the area where the cap visor is attached to the cap, the foldable upper visor being foldable along a weakened area which enables the foldable upper visor to be separated from the lower visor to an open position, the pop-up display located between the lower and upper visors, a locking member for forming a composite structure, and an L-shaped spring disposed in both visors through both ends thereof, whereby when the foldable upper visor is opened up with respect to the lower visor, the pop-up display reveals and when the foldable upper visor is closed onto the lower visor, the pop-up display is hidden.

19 Claims, 2 Drawing Sheets

CAP VISOR CONTAINING DISPLAY MEANS

CROSS-REFERENCE TO RELATED APPLICATION

This is continuation-in-part application of U.S. Patent application Ser. No. 07/286,085, filed on Dec. 19, 1988, now abandoned.

BACKGROUND OF THE INVENTION

1. Field of the Invention

The present invention relates to a cap visor containing display means and more particularly, to an improved cap visor which includes a lower visor and a foldable upper visor being connected to each other in the area where the cap visor is attached to the cap, the foldable upper visor being foldable along a weakened area which enables the foldable upper visor to be separated from the lower visor to an open position. A plurality of legs which extend onto from the weakened area, a locking member, and a biased spring positioned where the cap visor meets the cap, whereby when the foldable upper visor is opened up with respect to the lower visor, the display means such as a pop-up display is visible and when the foldable upper visor is closed onto the lower visor, the display means is hidden.

2. Description of the Prior Art

Several types of cap visors having display means located between two foldable portions are well known in the art. However, such cap visors suffer from a number of difficulties such as, for example, two foldable portions do not hold in its open position and do not only form a composite visor but form a double layers visor as shown in the U.S. Pat. Des. 284,328, U.S. Pat. Des. 258,323, U.S. Pat. No. 911,126, U.S. Pat. No. 2,475,471, U.S. Pat. No. 2,648,847, and U.S. Pat. No. 2,735,109.

SUMMARY OF THE INVENTION

Accordingly, it is an object of the present invention to provide a cap visor containing display means such as a pop-up display.

Another object of the present invention is to provide an improved cap visor which includes a lower visor, a foldable upper visor, and a pop-up display located between the lower and foldable upper visors.

A further object of the present invention is to provide a cap visor containing a pop-up display which includes a lower visor member, a foldable upper visor member having a pair of legs which extend onto from the weakened area, an L-shaped spring disposed in both lower and foldable upper visor members through both ends thereof, and a locking member for holding the foldable upper visor member to the lower visor, whereby when the foldable upper visor member is opened up with respect to the lower visor in an angle of 90° about the lower visor member by releasing from the locking member, the foldable upper visor member is popped up by legs against the lower visor member and the pop-up display is visible caused by the L-shaped spring, and when the foldable upper visor member is closed onto the lower visor, the pop-up display is hidden.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a cap visor having display means which includes a lower visor, a foldable upper visor being connected to each other in the area where the cap visor is attached to the cap, the foldable upper visor being foldable along a weakened area which enables the foldable upper visor to be separated from the lower visor to an open position, the pop-up display located between the lower and upper visors, a locking member for forming a composite structure, and an L-shaped spring disposed in both visors through both ends thereof, whereby when the foldable upper visor is opened up with respect to the lower visor, the pop-up display reveals and when the foldable upper visor is closed onto the lower visor, the pop-up display is hidden.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
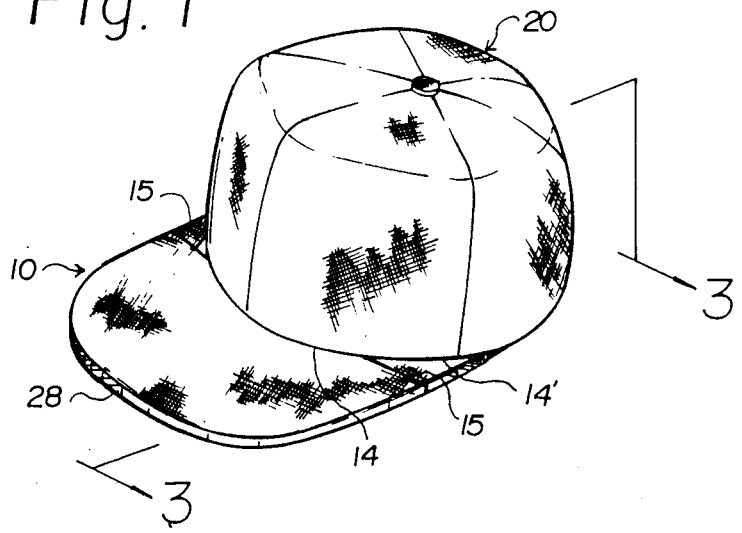
FIG. 1 is a perspective view of a cap visor including display means according to the present invention.

Referring now in detail to the drawings for the purpose of illustrating preferred embodiments of the present invention, the cap visor having display means such as a pop-up display as shown in FIGS. 1, 2, 3, and 4, which comprises a lower visor member 12, a foldable upper visor member 13, and the display means 11 located between the lower and foldable upper visor members 12 and 13. The lower and foldable upper visor members 12 and 13 are connected to each other in an area 14 where the cap visor 10 is attached to a cap 20. The foldable upper visor member 13 is foldable along a weakened area 15 which enables the foldable upper visor member 13 to be separated from the lower visor member 12 to an open position.

Figure 2:
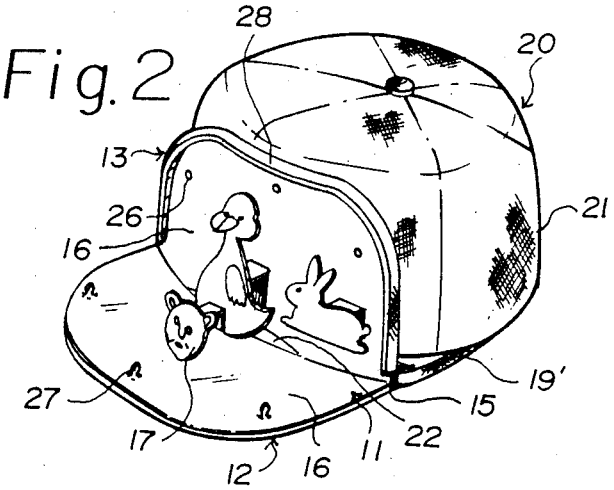
FIG. 2 is a perspective view of the cap visor shown in its open position and revealing the pop-up display according to the present invention.

The display means 11 such as a pop-up display, advertising means, and the like includes a display base member 16 adapted to receive displays 17 supported thereon. The display base member 16 is attached to the lower visor member 12 and the foldable upper visor member 13 by an adhesive 18 such as glue. When the visors 12 and 13 are in the open position thereof, the display means 11 presents a three-dimensional display and when the visors 12 and 13 are in the close position thereof, the display means 11 folds flat (FIG. 2).

The foldable upper visor member 13 includes a rigid member 19 covered by a flexible covering member 21.

Figure 4:
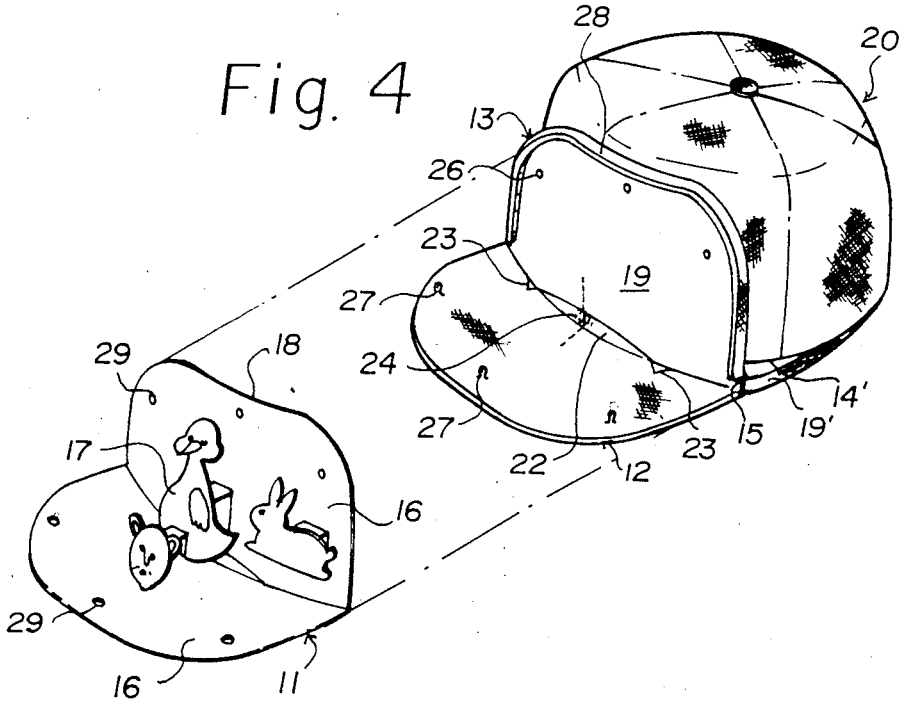
FIG. 4 is an exploded, perspective view of the cap visor according to the present invention in order to illustrate the construction of basic components of the present invention.

Accordingly, the weakened area 15 is provided in the rigid member 19. Therefore, the flexible covering member 21 such as cotton cloth, vinyl material, and the like acts as a hinge for the foldable upper visor member 13. Thus the rigid member 19 is cut or perforated from a pair of remaining rigid members 19' disposed at both end areas thereof. The remaining rigid members 19' are connected to the cap 20 in an extending area 14' extended from the area 14 (FIG. 4). Accordingly, the weakened area 15 is a perforated area along which the foldable upper visor member 13 can be separated from the lower visor member 12. The weakened area 15 is a cut which extends at least a portion of the distance across the foldable upper visor member 13 and extends at least a portion of the distance the foldable upper visor member 13. The rigid member 19 is made of a cardboard. The rigid member 19 is provided with an arc portion area 22 disposed around the center portion of the bottom of the foldable upper visor member 13. A plurality of leg members 23 extend from the weakened area 15 for tightly holding the foldable upper visor member 13 when the foldable upper visor member 13 is opened up with respect to the lower visor member 13 and the display means 11 is visible (FIG. 4).

Figure 5:
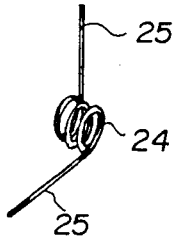
FIG. 5 is a perspective view of an L-shaped spring disposed in upper and lower visors of the cap visor according to the present invention.

As shown in FIGS. 4 and 5, an L-shaped biased spring 24 defining both ends 25 is disposed in the arc portion area 22 and both ends are buried in the lower visor member 12 and the foldable upper visor member 13. The biased spring 24 can be a biased plate spring. A number of biased springs 24 may be disposed in the arc portion area 22.

The foldable upper visor member 13 contains a plurality of engaging apertures 26 disposed thereon and the lower visor member 12 contains a plurality of notches 27 disposed thereon for slidably locking to and releasing from the engaging apertures 26 (FIG. 2). Thus the locking member is a male-female component. Also, the locking member includes a hook and loop fastener such as VELCRO strip members disposed between the lower visor member 12 and the foldable upper visor member 13 for securing the lower and upper visor members 12 and 13 through a plurality of apertures 29 disposed in the display base member 16 together form a composite structure.

Figure 3:
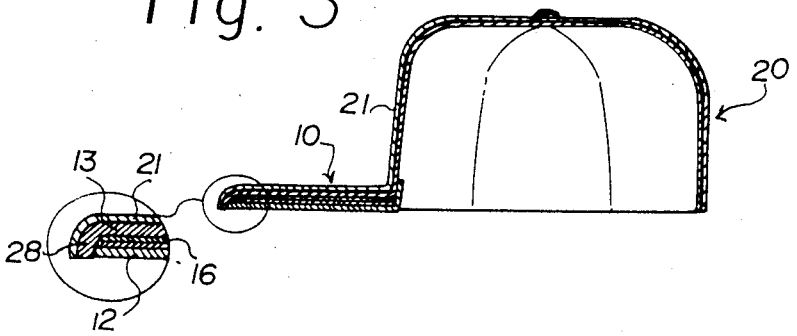
FIG. 3 is a sectional view of FIG. 1, taken along line 3—3.

As shown in FIGS. 2 and 3, the foldable upper visor member 13 is provided with a peripheral lip 28 and the lower visor member 12 is slightly smaller than the foldable upper visor member 13 so that when the lower and foldable upper visor members 12 and 13 are closed in each other. That is, the lower visor member 12 nestles within the foldable upper visor member behind the peripheral lip 28.

According to the present invention, the cap visor containing display means operates as follows:

When the foldable upper visor member 13 is opened up with respect to the lower visor member 12 by releasing the engaging apertures 26 from the notches 27, the foldable upper visor member 13 is automatically separated from the lower visor member 12 by the L-shaped biased spring 24 and simultaneously leg members 23 hold the foldable upper visor member 13 against the lower visor member 12 so that the foldable upper visor member 13 is popped up in an angle of 90° about the lower visor member 12. Accordingly, the pop-up display 11 is visible in its open position. On the contrary, when the foldable upper visor member 13 is closed onto the lower visor member 12, the notches 27 disposed on the lower visor member 12 are locked into the engaging apertures 26 of the foldable upper visor member 13 and simultaneously, the lower visor member 12 nestles within the foldable visor member 13 behind the peripheral lip 28 of the foldable upper visor member 13 so that the lower and foldable upper visor members 12 and 13 are secured together to form a composite structure as the cap visor attached to the cap 20.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A cap visor containing display means, which is adapted to be attached to a cap to be worn by a person, which comprises:

a lower visor member and a foldable upper visor member, said foldable upper and lower visor member being connected to each other in the area where the cap visor is attached to the cap, said foldable upper visor member being foldable along a weakened area which enables the foldable upper visor member to be separated from the lower visor member to an open position, said foldable upper visor member being provided with a peripheral lip, and said lower visor member being slightly smaller than the foldable upper visor member so that when the lower and the foldable upper visor members are closed on each other, the lower visor member nestles within the foldable upper visor member behind the peripheral lip, means for holding the foldable upper visor member in its open position, and display means located between said lower visor member and said foldable upper visor member whereby when the foldable upper visor member is separated from the lower visor member, said display means becomes visible.

2. The cap visor of claim 1, wherein a locking member is provided between the lower visor member and the foldable upper visor member for securing said lower and foldable upper visor members together to form a composite structure.

3. The cap visor of claim 2, wherein the locking member is a male-female component.

4. The cap visor of claim 2, wherein the locking member includes a hook and loop fastener.

5. The cap visor of claim 2, wherein the locking member includes a plurality of engaging apertures disposed on said foldable upper visor member and a plurality of notches disposed on said lower visor member for locking to and releasing from said engaging apertures.

6. The cap visor of claim 1, wherein the holding means is at least one biased spring member positioned where said cap visor meets the cap.

7. The cap visor of claim 1, wherein the holding means is a plurality of leg members which extend from said weakened area.

8. The cap visor of claim 1, wherein the weakened area is a perforated area along which the foldable upper visor member can be separated from the lower visor member.

9. The cap visor of claim 1, wherein the weakened area is a cut which extends at least a portion of a distance across the foldable upper visor member.

10. The cap visor of claim 1, wherein the weakened area extends at least a portion of the distance across the foldable upper visor member.

11. The cap visor of claim 1, wherein the foldable upper visor member includes a rigid member covered by a flexible covering member, said weakened area being provided in the rigid member, whereby the flexible covering member acts as a hinge for the foldable upper visor member.

12. The cap visor of claim 11, wherein the rigid member of the foldable upper visor member is made of a cardboard.

13. The cap visor of claim 11, wherein the flexible covering member is made of cotton cloth.

14. The cap visor of claim 11, wherein the flexible covering member is made of vinyl material.

15. The cap visor of claim 1, wherein the display means is a pop-up display.

16. The cap visor of claim 1, wherein the display means is advertising means.

17. The cap visor of claim 1, wherein the display means is provided with a base member, thereby supporting the display means, said base member attached to said lower visor member and said foldable upper visor.

18. The cap visor of claim 17, wherein the base member of the display means is attached to both lower visor and foldable upper visor by an adhesive.

19. The cap visor of claim 17, wherein when the upper and lower visor are separated, a three-dimensional display is presented, and when said upper and lower visors are closed on each other, the display means folds flat.

* * * * *